US005887764A

United States Patent [19]

Ennis, III et al.

[11] Patent Number: 5,887,764

[45] Date of Patent: Mar. 30, 1999

[54] APPARATUS FOR A PRESSURIZED INJECTOR

[76] Inventors: James F. Ennis, III, 260 Rte. 2, Preston, Pa. 06365; Mark L. Anderson, 303 S. Mackay Ave., Spring Valley, Wis. 54767

[21] Appl. No.: 753,708

[22] Filed: Nov. 27, 1996

[51] Int. Cl.[6] ..... B67D 5/42; B67D 5/32; B67D 5/33

[52] U.S. Cl. ..... 222/389; 222/386; 222/153.61; 222/153.09

[58] Field of Search ..... 222/153.01, 153.09, 222/386, 389

[56] References Cited

U.S. PATENT DOCUMENTS

| | | | |
|---|---|---|---|
| 3,688,765 | 9/1972 | Gasaway | 128/173 H |
| 3,768,472 | 10/1973 | Hodosh et al. | 128/218 P |
| 3,780,734 | 12/1973 | Wulff | 128/218 R |
| 3,831,816 | 8/1974 | Pauliukonis | 222/135 |
| 4,595,002 | 6/1986 | Michaels et al. | 222/153.01 |
| 4,717,384 | 1/1988 | Waldeisen | 604/143 |
| 4,858,776 | 8/1989 | Mehra | 215/270 |
| 5,238,153 | 8/1993 | Mass et al. | 222/153.09 |

FOREIGN PATENT DOCUMENTS

| | | | |
|---|---|---|---|
| 478678A | 11/1951 | Canada | 222/153.09 |

*Primary Examiner*—Andres Kashnikow
*Assistant Examiner*—Keats Quinalty
*Attorney, Agent, or Firm*—Skinner and Associates

[57] ABSTRACT

An apparatus for maintaining a sealed environment in the pressurized barrel reservoir injector which comprises a plastic closure cap that mates with a barrel reservoir with a dispensing tip. The closure cap has a top wall and a circular outer side wall extending downward from the top wall, and an annular sealing rib for engagement with an annular planar surface. Importantly, the cap also has three locking tabs that have a ascending horizontal top surface that engage external tabs on the reservoir, and also having an interior groove that houses a series of three nodes that are evenly spaced and positioned slightly ahead of the leading end of each locking tab. The external threading tabs of the reservoir pass counter-clockwise through the groove and pass over the nodes. The nodes act to maximize tension of the cap locking tab against the end of the external reservoir tab thereby preventing loosening of the cap.

10 Claims, 1 Drawing Sheet

APPARATUS FOR A PRESSURIZED INJECTOR

CROSS-REFERENCE TO RELATED APPLICATIONS

Not applicable

STATEMENT REGARDING FEDERALLY SPONSORED RESEARCH OR DEVELOPMENT

Not applicable.

REFERENCE TO A MICROFICHE APPENDIX

Not Applicable.

BACKGROUND OF THE INVENTION

1. Field of the Invention

The present invention relates, generally, to fluid dispensers, and more particularly, to apparatus for dispensing fluids from a pressurized injector barrel reservoir. A closure cap provided by this invention prevents retrogression of the cap from the barrel reservoir and a subsequent loss of air pressure from within the dispenser. This is highly important to the operator who relies on a predictable measure of air pressure inside the barrel reservoir in order to dispense fluids with the precision required to meet industry standards and specifications.

2. Background Information

In the past, various devices and methods have been used or proposed to create and maintain a sealed environment in injector-type barrel reservoir apparatus. Molded plastic closure caps for pneumatic dispensers of fluids such as pharmaceuticals, nutritional supplements, adhesives, lubricants, chemicals, inks and other fluid compositions are in wide use today. A broken seal between the cap and the reservoir is a problem common to this type of dispenser. The subsequent loss of air pressure inside of the dispenser and, depending on the fluid contents in the dispenser, the very real possibility of contamination to the environment or injury to the operator exist and are a serious problem.

The seal can be breached by various ways and means such as pulsating air pressure inside the reservoir or the harsh conditions typically found in stockyards. An operator administering pharmaceuticals or nutritional supplements to livestock must, at times, physically restrain the animals. This is difficult and fatiguing work thereby making applications using pressurized injectors preferable over injections given via hand syringes that are slow, messy, and fatiguing to use. Pneumatic dispensers are preferred when quality-control and safety are a priority. Controlled air-pressure allows the operator to make faster deposits exactly where they are needed without mess and waste. And air-powered dispensers that incorporate adjustable air output provide exact fluid flow control.

Various devices and methods have been used and proposed to overcome the problem of a broken seal between the reservoir and cap of an injector type syringe. However, these devices have significant limitations and shortcomings. Specifically, one prior art apparatus relies on a cooperating locking mechanism to hold the cap in a sealed relationship with the reservoir. The closure cap of the above mentioned prior art includes an annular sealing rib having a generally arcuate mating surface for engagement with the annular planar mating surface of the plastic container. The cap's internal threads engage the reservoir's external threads. As the closure is tightened into sealing relationship with the reservoir, the arcuate mating surface engages the cap's planar mating surface. While this provides a good seal between the closure cap and the reservoir, this arrangement still does not contribute sufficient tension to prohibit a backward creeping action and a possible broken seal between the component parts.

Despite the need for a device and method in the art which overcomes the disadvantages and limitations of the prior art, none insofar is known or has been developed. Accordingly, it is an object of the present invention to provide an improved pressurized barrel injector apparatus which is specifically directed at overcoming all of the problems previously enumerated regarding the performance of a sealing closure cap. This is accomplished through a series of three nodes that provide static pressure on the reservoir's external threading tabs thereby preventing the cap from creeping backward or loosening.

BRIEF SUMMARY OF THE INVENTION

The present invention provides an apparatus for maintaining a sealed environment in the pressurized barrel reservoir injector which comprises a plastic closure cap that mates with a barrel reservoir with a dispensing tip. The significant feature of this invention is a closure cap having a top wall and a circular outer side wall extending downward from the top wall, an annular sealing rib for engagement with an annular planar surface, three locking tabs each having an ascending (from right to left when viewed in the cap's interior) horizontal top surface that engage three external tabs on the reservoir, and also having an interior groove that houses a series of three nodes that are evenly spaced and positioned approximately 0.25 inches ahead of the leading end of each locking tab. The external threading tabs of the reservoir pass counter-clockwise through the groove and pass over the nodes. The nodes act to provide maximum tension between the locking tabs and threading tabs thereby holding the cap in place on the reservoir and maintaining the seal. In the particular embodiment illustrated, the closure cap is preferably made of ABS plastic, however, the cap can be made of any hard plastic or metal material The features, benefits and objects of this invention will become clear to those skilled in the art by reference to the following description, claims and drawings.

DETAILED DESCRIPTION

Figure 1:
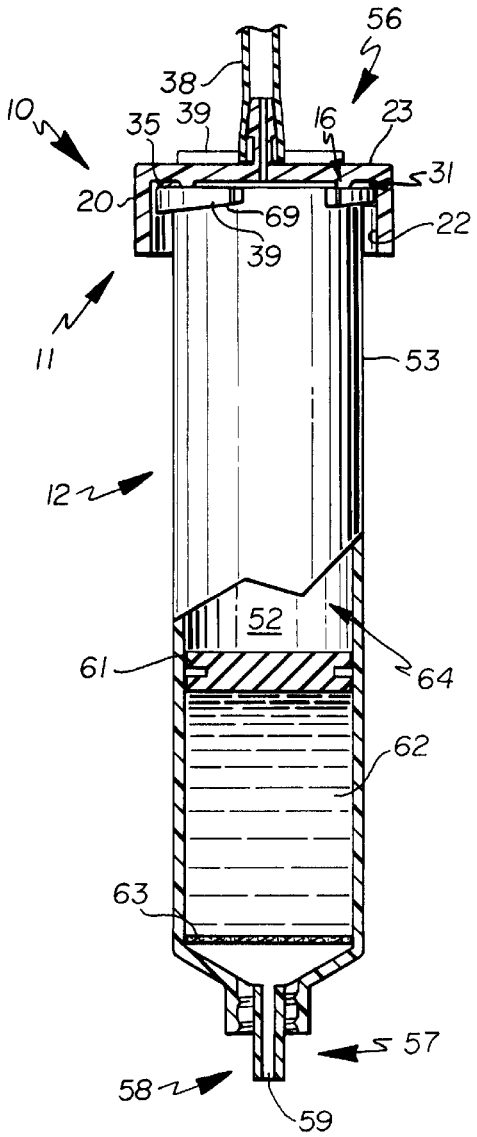
FIG. 1 is a side view, partially in cross section, illustrating the components and function of a closure cap in relationship to the reservoir of the dispenser.

Referring to FIG. 1, an example of the preferred embodiment of the present invention is illustrated and generally indicated by the reference numeral 10. The barrel reservoir injector is described below first in terms of its major structural elements and then in terms of its secondary structural and functional elements which cooperate to perform the essential function.

In the preferred embodiment, as shown in FIG. 1, an air-powered fluid dispensing mechanism 10 utilized for administering pharmaceuticals and fluid substances comprises a closure cap 11, a reservoir 12 and a plunger 61. The mechanism 10 is shown to have a proximal end 56 and a distal end 58. Basically, the proximal end 56 of the mechanism 10 is for operator manipulation and the distal end 58 is for insertion into the animals body. Located at the proximal end 56 of the mechanism 10 is an air inlet 36 which provides for entry of pressurized air into the dispenser 10 via an air-hose 38. Pressurized air entering the mechanism 10 through the air inlet 36 acts upon the plunger 61 to force the reservoir's 12 fluid contents 62 through an outlet 59 in the distal end 58. Although this barrel injector 10 is primarily for dispensing pharmaceuticals into livestock, it could also be used for administering inks, lubricants, adhesives, etc., in an industrial environment.

Figure 2:
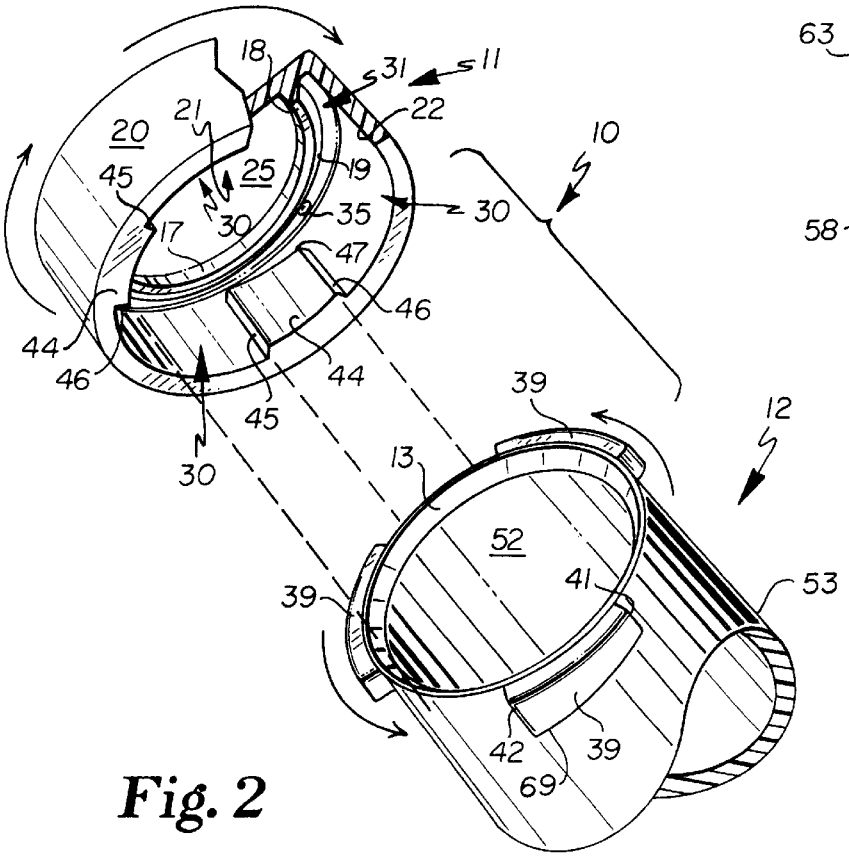
FIG. 2 is an exploded perspective view of the reservoir top edge and the closure cap shown partially in cross section to illustrate the essential parts of the cap.

The cap 11 is preferably made of a rigid material such as ABS plastic. It comprises a top surface 23 and a continuous side wall extending at a right angle to the top surface 23. The cap top surface 23 and side wall 20 define an interior cavity 21. The reservoir 12 has a cylindrical, elongated body. As shown in FIG. 2, a reservoir inner wall surface 52 terminates at the proximal end in a beveled surface 13. An outer reservoir wall surface 53 terminates at the proximal end in a plurality of tabs 39. The barrel reservoir 12 may be constructed of a polymeric material.

Figure 3:
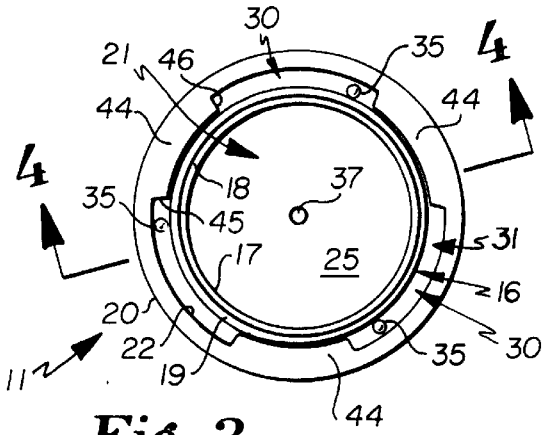
FIG. 3 is a bottom view of the closure cap.

Referring also to FIG. 3, the interior 21 of the cap 11 is defined by a surface 25 and a inner wall surface 22. Surface 25 comprises an annular sealing ring 16, a channel or groove 31, and a plurality of protruding nodes 35 that are evenly disposed about the groove 31. The inner surface 22 of the cap's side wall 20 comprises a plurality of locking tabs 44 that extend outwardly toward the longitudinal axis of the cap 11. The inner wall surface 22 is further defined by an a plurality of open spaces 30, a space 30 being between the leading end 46 of a tab 44 and the trailing end 45 of the adjacent locking tab 44. The convex nodes 35, being approximately 1/16 inch in diameter, extend from the top wall surface 25 into the interior cavity 21 approximately 0.10 inches and are located approximately ¼ inch (0.075 mm) forward of a leading end surface 46 of a respective locking tab 44.

Figure 4:
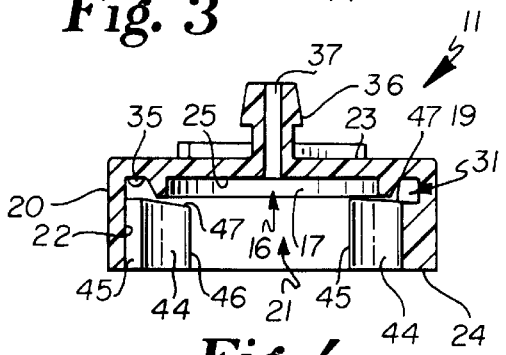
FIG. 4 is a cross-sectional side view of the cap taken along section line 4-of FIG. 3.

Referring to FIG. 2, the cap is secured to the reservoir by first aligning the external reservoir tabs 39 with the cap's open spaces 30 and sliding the tabs 39 vertically through the open space 30 until the tabs engage the inner groove 31. The interior groove or channel 31 is defined by the surface 25, the inner wall surface 22 and a beveled side wall 19 of the annular planar sealing ring 16. As is best shown in FIGS. 2 and 4, the horizontal top surface 47 of each locking tab 44 ascends from right to left. The vertical leading end surface 46 of each locking tab 44 measures approximately ⅜ inch and the trailing vertical end wall 45 of each locking tab 44 is approximately 9/16 inches high. The cap 11 is then twisted in a counterclockwise direction until the declining bottom surface 69 of the external tab 39 has passed over the inclined top surface 47 of the locking tab 44. The external tab 39 traveling through the channel 31 is compressed into the diminishing space between the inclined horizontal top surface 47 of the locking tab 44 and the bottom surface 25 of the cap 11. With the external tab 39 advanced to this position in the interior groove 31, the trailing end 45 of each respective locking tab 44 has passed over and is adjacent to a node or detent 35. When the cap 11 is tightened onto the reservoir 12, the beveled surface 19 of the annular sealing ring 16 is in full contact with the beveled top edge 13 of the reservoir and a seal is made between the cap 11 and the barrel reservoir 12. The tabs 39 end surfaces 42 bypass the nodes 35 thereby creating a detent that must be forcibly overcome to disengage the cap 11 from the reservoir 12. The nodes 35 thereby block and prevent the reservoir's 12 external tabs 39 from backing out of the interior groove 31 while the mechanism's 10 contents are under pneumatic pressure or being manually manipulated, and the integrity of the seal between the cap 11 and the reservoir 12 is maintained.

The annular sealing rib 16, as shown in FIGS. 2, 3, and 4, comprises an inside vertical wall 17 that extends into the cap interior 21 approximately 3/32 inch (0.025 mm) from the top wall 23 of the cap 11, a narrow bottom surface 18 and an outside beveled wall 19 that angles inwardly toward the longitudinal axis of the cap 11 at approximately 28°.

Referring to FIG. 1, here are two basic types of pneumatic dispensers: manually controlled for "by-eye" deposits and automated controlled for automatic repeat deposits. Both types provide precise fluid flow control, allowing the user to determine where the fluid is deposited. Air-powered dispensers offer the operator and industry some significant advantages over manually operated dispensers. Air-powered dispensers reduce operator fatigue and the physical stress often associated with repetitive movements. And, they dispense all fluids in a predictable manner to produce neat, clean deposits through a needle or other similar appliance that is attached to a locking tip 57 in the distal end 58 of the reservoir 12. A consistent amount of air pressure inside the barrel reservoir injector mechanism 10 is, therefore, highly important to the user who depends on the dispenser's 10 performance to meet precise, high-quality industry and/or medical standards for specific applications.

As shown in FIG. 1, a plunger piston 61, preferably made from a semi-rigid rubber or plastic material and with a diameter slightly larger than the interior diameter of the elongated barrel reservoir 12, as defined by the reservoir's inner side wall 52, prohibits the fluid content 62 of the barrel reservoir 12 trapped below it from migrating into the air space 64 above the plunger 61. Pressurized air introduced through the air inlet opening 37 forces the plunger 61 steadily downward and, thereby, forces the fluid content 62 to evacuate the reservoir 12 through a needle or other special dispensing tip attached to the locking tip 57.

Alternatively, a filter 63, that can be manufactured from a variety of materials, can be positioned at the bottom of the reservoir 12. This option would be utilized whenever the reservoir's 12 fluid contents 62 were going to be extracted via a drip method that would require vertical alignment of the dispenser 10 as shown in FIG. 1.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

The invention claimed is:

1. A pressurized fluid dispensing mechanism, comprising:

a. a cylindrical cap having a top surface of a predetermined perimeter, a continuous side wall disposed at said top surface perimeter and extending at a right angle therefrom, said top surface and side wall defining an interior cavity, said cap further having an air inlet disposed in said cap top surface, said cap further comprising a sealing annular ring disposed on said cap top surface and extending therefrom a predetermined distance into said interior cavity, said annular ring having a beveled outer surface, a flat bottom surface and a vertical inner surface, and said cap further comprising an interior fitment groove, said groove being defined by said cap top surface, said cap side wall and said vertical outer surface of said annular sealing ring; and b. a cylindrical barrel reservoir having an open proximal end, said proximal end adapted for connection to said cap in said interior cavity thereof, and a closed distal end, said distal end having a fluid dispensing outlet.

2. The mechanism of claim 1, wherein said cap further comprises a plurality of locking tabs extending outwardly from said cap side wall, said locking tabs being generally rectangular and wherein each locking tab comprises a concave front surface, two opposing side surfaces, a flat bottom surface that is coexistent with said side wall of said cap, said locking tabs further having a horizontally inclined top surface.

3. The mechanism of claim 2, wherein said cap further comprises a plurality of securement nodes, said nodes protruding from said cap top surface into said interior fitment groove and each said node being disposed slightly in front of each said respective said locking tab.

4. The mechanism of claim 1, wherein said cap is constructed of a plastic or a metal material having a predetermined thickness and predetermined rigidity.

5. The mechanism of claim 1, wherein said barrel reservoir proximal end comprises an outer surface and an inner surface, said inner surface having a sealing beveled top edge.

6. The mechanism of claim 5, wherein said barrel proximal end comprises a plurality of external locking tabs evenly disposed about said outer surface.

7. The mechanism of claim 6, wherein each said barrel reservoir locking tab comprises a top horizontal surface contiguous to the planar circumference of said proximal end, opposing vertical side surfaces, and a horizontal declining bottom surface.

8. An air-powered, pressurized fluid dispensing mechanism, comprising:

a. a cylindrical cap having a top surface of a predetermined perimeter, a continuous side wall disposed at said top wall surface perimeter and extending at a right angle therefrom, said top surface and side wall defining an interior cavity, said cap further having an air inlet disposed in said cap top surface, a plurality of locking tabs disposed on said cap side wall and extending into said interior cavity, and a plurality of securement nodes disposed on said cap top surface; and b. a cylindrical barrel reservoir having an open proximal end, said proximal end adapted for connection to said cap in said interior cavity thereof, and a closed distal end, said distal end having a fluid dispensing outlet, said barrel reservoir further having a plurality of locking tabs disposed on an outer surface thereof, whereby said cap and barrel locking tabs are adapted for cooperative engagement with one another to lock said cap to said barrel reservoir, and said securement nodes block disengagement of said barrel locking tabs with said cap locking tabs.

9. An air-powered, pressurized, fluid dispensing mechanism for administering veterinary pharmaceuticals, nutritional supplements, and other fluid substances, comprising:

a. a cylindrical cap having a top surface of a predetermined perimeter, a continuous side wall disposed at said top wall surface perimeter and extending at a right angle therefrom, said top surface and side wall defining an interior cavity, said cap further having an air inlet disposed in said cap top surface, a plurality of locking tabs disposed on said cap side wall and extending into said interior cavity, a plurality of securement nodes disposed on said cap top surface and a sealing annular ring disposed on said cap top surface and extending therefrom a predetermined distance into said interior cavity; and b. a cylindrical barrel reservoir having an open proximal end, said proximal end adapted for connection to said cap in said interior cavity thereof, and a closed distal end, said distal end having a fluid dispensing outlet, said barrel reservoir further having a plurality of locking tabs disposed on an outer surface thereof, and an inner surface having a sealing beveled top edge, whereby said cap sealing annular ring and said barrel beveled top edge are adapted for cooperative engagement with one another to form a pressure tight seal and whereby said cap and barrel locking tabs are adapted for cooperative engagement with one another to lock said cap to said barrel reservoir, and said securement nodes blocking disengagement of said barrel locking tabs with said cap locking tabs.

10. A pressurized fluid dispensing mechanism, comprising:

a. a cylindrical cap having a top surface of a predetermined perimeter, a continuous side wall disposed at said top surface perimeter and extending at a right angle therefrom, said top surface and side wall defining an interior cavity, said cap further having an air inlet disposed in said cap top surface; and b. a cylindrical barrel reservoir having an open proximal end, said proximal end adapted for connection to said cap in said interior cavity thereof and comprising an outer surface and an inner surface, said inner surface having a sealing beveled top edge, and said barrel reservoir further having a closed distal end, said distal end having a fluid dispensing outlet, and said barrel reservoir proximal end.

* * * * *